US012690726B2

(12) United States Patent
Larsson et al.

(10) Patent No.: US 12,690,726 B2
(45) Date of Patent: Jul. 28, 2026

(54) DISPENSER

(71) Applicant: Essity Hygiene and Health Aktiebolag, Gothenburg (SE)

(72) Inventors: Björn Larsson, Billdal (SE); Per Moller, Borlänge (SE); David Sahlin, Gothenburg (SE); Lars Thorén, Borlänge (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 197 days.

(21) Appl. No.: 17/337,917

(22) Filed: Jun. 3, 2021

(65) Prior Publication Data

US 2021/0321832 A1 Oct. 21, 2021

Related U.S. Application Data

(60) Continuation of application No. 16/946,041, filed on Jun. 3, 2020, now Pat. No. 11,206,956, which is a (Continued)

(51) Int. Cl.

| | |
|---|---|
| ***A47K 10/34*** | (2006.01) |
| *A47K 10/32* | (2006.01) |
| *A47K 10/42* | (2006.01) |

(52) U.S. Cl.

CPC ..... *A47K 10/34* (2013.01); *A47K 2010/3233* (2013.01); *A47K 10/421* (2013.01)

(58) Field of Classification Search

CPC ..... A47K 10/42; A47K 10/44; A47K 10/436; A47K 10/3612; A47K 10/3618; (Continued)

(56) References Cited

U.S. PATENT DOCUMENTS

| | | | |
|---|---|---|---|
| 804,306 | A | 11/1905 | Fonda |
| 804,307 | A | 11/1905 | Fonda |

(Continued)

FOREIGN PATENT DOCUMENTS

| | | | |
|---|---|---|---|
| CN | 2085219 | U | 9/1991 |
| CN | 2527209 | Y | 12/2002 |

(Continued)

OTHER PUBLICATIONS

Office Action (Notification of the First Office Action) issued on Mar. 19, 2021 by the China National Intellectual Property Administration (CNIPA) of the People's Republic of China in corresponding Chinese Patent Application No. 201911015648.5, and an English Translation of the Office Action. (19 pages).

(Continued)

*Primary Examiner* — Gene O Crawford
*Assistant Examiner* — Kelvin L Randall, Jr.
(74) *Attorney, Agent, or Firm* — BUCHANAN INGERSOLL & ROONEY PC

(57) ABSTRACT

A dispenser for dispensing at least one perforated web from a storage of web material, the dispenser including: a housing arranged to hold a storage of perforated web material, wherein a web path extends along a feeding direction in an interior of the housing from a storage position to a dispensing opening of the dispenser, and a separation arrangement being arranged along said web path, for separating the at least one perforated web along the perforations thereof, said separation arrangement including a first unit and a second unit, the second unit being arranged downstream said first unit, as seen in the feeding direction of the web path. The first unit is arranged to provide a tensioning force on said web, and the second unit being arranged to stretch the web material along the length of the web and along the width of the web.

26 Claims, 6 Drawing Sheets

Related U.S. Application Data division of application No. 15/307,313, filed as application No. PCT/SE2014/050518 on Apr. 28, 2014.

(58) Field of Classification Search
CPC ..... A47K 2010/326; A47K 2010/3286; A47K 2010/3675
See application file for complete search history.

(56) References Cited

U.S. PATENT DOCUMENTS 1,658,608 A 2/1928 Marcuse
2,347,823 A 5/1944 Gootman et al.
2,809,082 A * 10/1957 Marcuse ..... A47K 10/34 226/186
2,886,226 A 5/1959 Batlas et al.
2,974,839 A 3/1961 Batlas et al.
3,653,539 A 4/1972 Stageberg
3,770,172 A 11/1973 Nystrand et al.
3,826,548 A 7/1974 Schnyder et al.
3,877,576 A 4/1975 Kishi et al.
3,991,998 A 11/1976 Banz et al.
4,089,378 A 5/1978 Suzuki et al.
4,106,684 A 8/1978 Hartbauer et al.
4,148,442 A 4/1979 Baumann et al.
4,276,797 A 7/1981 Baumann et al.
4,288,068 A * 9/1981 Hashimoto ..... B65H 3/5261 271/125
4,358,169 A 11/1982 Filipowicz et al.
4,494,747 A 1/1985 Graef et al.
4,516,711 A 5/1985 Barege
4,614,632 A 9/1986 Kezuka et al.
4,684,119 A 8/1987 Lane
4,697,656 A 10/1987 De
4,779,861 A 10/1988 Ozawa et al.
4,818,042 A 4/1989 Arabian et al.
4,861,013 A 8/1989 Shibata et al.
5,033,620 A 7/1991 De Luca
5,061,232 A 10/1991 Bloch et al.
5,092,573 A 3/1992 Abreu
5,098,078 A 3/1992 Nakanishi
5,152,522 A 10/1992 Yamashita
5,190,514 A 3/1993 Galvanauskas
5,203,846 A * 4/1993 Kuhns ..... B65H 5/062 271/274
5,205,454 A * 4/1993 Schutz ..... B65H 35/10 242/419.5
5,265,509 A 11/1993 Chen
5,372,359 A 12/1994 Miura et al.
5,375,785 A * 12/1994 Boone ..... A47K 10/3656 242/560.1
5,518,144 A 5/1996 Samuelson et al.
5,653,439 A * 8/1997 Rider ..... B41J 13/106 271/274
5,868,275 A * 2/1999 Moody ..... A47K 10/16 221/33
5,882,004 A 3/1999 Padget
5,924,687 A 7/1999 Hannon
5,975,518 A 11/1999 Wakana et al.
6,070,867 A 6/2000 Tsurumi et al.
6,186,490 B1 2/2001 Sugiura et al.
6,213,346 B1 * 4/2001 Skerrett ..... A47K 10/42 221/48
6,311,819 B1 11/2001 Stromme et al.
6,447,864 B2 9/2002 Johnson et al.
6,520,408 B1 2/2003 Force et al.
6,536,624 B2 * 3/2003 Johnson ..... A47K 10/16 221/45
6,609,449 B2 8/2003 Granger
6,655,679 B2 12/2003 Boucher et al.
6,736,466 B1 5/2004 Helland et al.
6,860,447 B2 3/2005 Boone et al.
6,971,542 B2 12/2005 Vogel et al.
7,144,006 B2 12/2006 Graef et al.
7,191,657 B2 3/2007 Maier et al.
7,472,802 B2 1/2009 van Riel
7,878,445 B2 2/2011 Granger et al.
7,954,405 B2 6/2011 Kling
8,741,410 B2 6/2014 Cattacin et al.
8,857,611 B2 10/2014 Thorburn
8,899,508 B2 12/2014 Hjort et al.
8,910,941 B2 12/2014 Jacobs
9,572,460 B2 2/2017 Petocchei et al.
9,668,621 B2 6/2017 Andersson et al.
9,999,325 B2 6/2018 Larsson et al.
10,390,664 B2 8/2019 Larsson et al.
10,568,471 B2 2/2020 Larsson et al.
10,758,096 B2 9/2020 Larsson
2001/0020626 A1 9/2001 Skerrett et al.
2002/0033405 A1 3/2002 Gergek et al.
2003/0080137 A1 5/2003 Clark et al.
2003/0110915 A1 6/2003 Kapiloff et al.
2003/0121970 A1 7/2003 Force et al.
2004/0041330 A1 3/2004 Ko et al.
2004/0256516 A1 12/2004 Granger
2005/0223860 A1 10/2005 Formon
2005/0275153 A1 12/2005 Owa
2006/0065094 A1 3/2006 Lewis et al.
2007/0010389 A1 1/2007 Cutrona et al.
2007/0034534 A1 2/2007 Vanburen
2007/0089582 A1 4/2007 Formon
2007/0145062 A1 6/2007 Formon et al.
2007/0236110 A1 * 10/2007 Kling ..... A47K 10/36 312/34.4
2008/0121649 A1 5/2008 Kistner
2009/0005747 A1 1/2009 Michaels et al.
2009/0014945 A1 1/2009 Izumichi et al.
2009/0046136 A1 2/2009 Choi et al.
2009/0057478 A1 3/2009 Conner
2010/0025519 A1 2/2010 Granger et al.
2010/0046994 A1 2/2010 Kikuchi et al.
2010/0068092 A1 * 3/2010 Larsson ..... A61L 9/14 422/123
2010/0258579 A1 10/2010 Billman et al.
2011/0089213 A1 4/2011 Granger
2011/0101020 A1 5/2011 Granger
2011/0210137 A1 9/2011 Kling
2012/0085777 A1 * 4/2012 Bucci ..... B65H 35/10 221/30
2012/0193463 A1 8/2012 Newhouse et al.
2012/0211509 A1 * 8/2012 Granger ..... A47K 10/32 242/570
2013/0099924 A1 4/2013 Larsson et al.
2013/0105614 A1 * 5/2013 Hjort ..... A47K 10/36 242/564.5
2013/0161346 A1 6/2013 Wolme et al.
2013/0270290 A1 10/2013 Van Krieken et al.
2013/0277492 A1 10/2013 Granger et al.
2014/0144755 A1 5/2014 Jacobs
2014/0209624 A1 7/2014 Larsson
2015/0077449 A1 3/2015 Kobashi
2015/0102048 A1 4/2015 Case et al.
2015/0150423 A1 6/2015 Pommer et al.
2015/0282679 A1 10/2015 Larsson et al.
2015/0327733 A1 11/2015 Andersson et al.
2021/0085133 A1 3/2021 Larsson et al.

FOREIGN PATENT DOCUMENTS

CN 1600210 A 3/2005
CN 1625364 A 6/2005
CN 1937946 A 3/2007
CN 101026986 A 8/2007
CN 101080188 A 11/2007
CN 101351290 A 1/2009
CN 102281808 A 12/2011
CN 102395307 A 3/2012
CN 202173351 U 3/2012
CN 102762137 A 10/2012
CN 102905593 A 1/2013
CN 102984979 A 3/2013
CN 103607934 A 2/2014
CN 103648936 A 3/2014

(56) References Cited

FOREIGN PATENT DOCUMENTS

| | | | | |
|---|---|---|---|---|
| CN | 104188587 | A | 12/2014 | |
| CN | 104363807 | A | 2/2015 | |
| EP | 0154497 | A2 | 9/1985 | |
| EP | 0236709 | A1 | 9/1987 | |
| EP | 0392696 | A1 | 10/1990 | |
| EP | 1830687 | B1 | 5/2010 | |
| FR | 353284 | A | 9/1905 | |
| FR | 853084 | A | 3/1940 | |
| FR | 853284 | A | 3/1940 | |
| FR | 2539726 | A2 | 7/1984 | |
| FR | 2932671 | A1 | 12/2009 | |
| GB | 2433248 | A | 6/2007 | |
| JP | 2001247257 | A | 9/2001 | |
| JP | 2002065500 | A | 3/2002 | |
| JP | 2011194125 | A | 10/2011 | |
| RU | 2688358 | C1 | 5/2019 | |
| WO | 2004056250 | A1 | 7/2004 | |
| WO | 2006071148 | A1 | 7/2006 | |
| WO | 2007000153 | A1 | 1/2007 | |
| WO | WO-2007068883 | A1 * | 6/2007 | ..... A47K 10/16 |
| WO | 2008009760 | A2 | 1/2008 | |
| WO | 2008078168 | A2 | 7/2008 | |
| WO | 2011045493 | A1 | 4/2011 | |
| WO | 2011149393 | A1 | 12/2011 | |
| WO | 2012003867 | A1 | 1/2012 | |
| WO | 2012076775 | A1 | 6/2012 | |
| WO | 2012076776 | A1 | 6/2012 | |
| WO | 2012134362 | A1 | 10/2012 | |
| WO | 2013007302 | A2 | 1/2013 | |
| WO | 2013115687 | A1 | 8/2013 | |
| WO | 2013184049 | A1 | 12/2013 | |
| WO | 2020126048 | A1 | 6/2020 | |

OTHER PUBLICATIONS

Office Action issued on Mar. 25, 2021, by the Colombian Patent Office in Colombian Patent Application No. NC2020/0008801 and an English Translation of the Office Action. ( 26 pages).

Office Action (Examination report No. 1 for Standard Patent Application) issued on Oct. 20, 2017, by the Australian Patent Office in corresponding Australian Patent Application No. 2014392814. (4 pages).

Office Action issued on Mar. 20, 2018, by the Federal Service for Intellectual Property in Russian Patent Application No. 2016146116/12(074014) and an English Translation of the Office Action. (14 pages).

Office Action issued on May 17, 2019, by the Australian Government/IP Australia in corresponding Australian Patent Application No. 2018260790. (4 pages).

Office Action No. 12168, issued on Nov. 14, 2018, by the Colombian Patent Office in Colombian Patent Application No. NC2018/0009220 and Agents Letter in English Language, (11 pages).

Office Action No. 12173, issued on Nov. 8, 2018, by the Colombian Patent Office in Colombian Patent Application No. NC2017/0002817 and Agents Letter in English Language, (15 pages).

Office Action of about Jun. 30, 2018, by the Colombian Patent Office in corresponding Colombian Patent Application No. NC2017/0002817. (19 pages).

Second Examination Report issued on Apr. 9, 2018 by the Australian Patent Office in Australian Patent Application 2014392814, 4 pages.

The extended European Search Report issued on Nov. 6, 2017, by the European Patent Office in corresponding European Patent Application No. 14890725.6-1601. (12 pages).

Written Opinion of the International Preliminary Examining Authority (PCT Rule 66) (Form PCT/IPEA/408) issued on May 17, 2016, by the European Patent Office as the International Searching Authority for International Application No. PCT/SE2014/050518.

European Patent Office dated Aug. 22, 2014. (4 pages).

Notification of Transmittal of The International Preliminary Report on Patentability (Form PCT/IPEA/416) and International Preliminary Report on Patentability (Form PCT/IPEA/409), issued on Jul. 20, 2016, by the European Patent Office for International Application No. PCT/SE2014/050518.

Office Action (Notification of the First Office Action) issued on Sep. 14, 2018, by the State Intellectual Property Office of the People's Republic of China in corresponding Chinese Patent Application No. 201480079420.0, and an English Translation of the Office Action. (16 pages).

Office Action (Notification of the Second Office Action), issued on May 20, 2020, by the State Intellectual Property Office (SIPO) of the People's Republic of China in corresponding Chinese Patent Application No. 201480079420.1, and an English Translation of the Office Action. (13 pages).

Office Action (Notification of the third Office Action) issued on Aug. 21, 2017, by the State Intellectual Property Office (SIPO) of the People's Republic of China in the Chinese Patent Application No. 201280076596.2, and an English Translation of the Office Action. (21 pages).

Office Action {Notification of the second Office Action) issued on May 10, 2017, by the State Intellectual Property Office (SIPO) of the People's Republic of China in corresponding Chinese Patent Application No. 201280076557.2, and an English Translation of the Office Action. (20 pages).

Office Action (Notification of the Fourth Office Action) issued on Sep. 30, 2020, by the China National Intellectual Property Administration (CNIPA) of the People's Republic of China in corresponding Chinese Patent Application No. 201480079420.1 and an English Translation of the Office Action. (15 pages).

Office Action (Notification of the 2nd Office Action) issued on Jun. 24, 2020, by the National Intellectual Property Administration (CNIPA) of the People's Republic of China in corresponding Chinese Patent Application No. 201711308320.3, and an English Translation of the Office Action. (20 pages).

Office Action (Text of the First Office Action) issued on Nov. 22, 2019, by the State Intellectual Property Office (SIPO) of the People's Republic of China in corresponding Chinese Patent Application No. 201711308320.3 (31 pages).

Office Action (Notification of the First Office Action) issued on Sep. 19, 2016, by the State Intellectual Property Office (SIPO) of the People's Republic of China in Chinese Patent Application No. 201280076556.8, and an English Translation of the Office Action. (9 pages).

Office Action (Notification of the First Office Action) issued on Sep. 20, 2016, by the State Intellectual Property Office (SIPO) of the People's Republic of China in Chinese Patent Application No. 201280076596.2, and an English Translation of the Office Action. (19 pages).

Office Action (Notification of the second Office Action) issued on Apr. 10, 2017, by the State Intellectual Property Office (SIPO) of the People's Republic of China in Chinese Patent Application No. 201280076596.2, and an English Translation of the Office Action. (21 pages).

Office Action (Note No. 11541) issued on Sep. 15, 2020, by the Industry and Commerce in corresponding Colombian Patent Application No. NO2020/0008801, and an English Translation of the Office Action. (22 pages).

Office Action (Communication pursuant to Article 94(3) EPC) issued on Sep. 4, 2017, by the European Patent Office in the European Patent Application No. 12 887 211.6-1601. (5 pages).

The extended European Search Report issued May 6, 2016, by the European Patent Office in European Patent Application No. 12887211.6-1601. (9 pages).

The extended European Search Report issued May 6, 2016, by the European Patent Office in corresponding European Patent Application No. 12887301.5-1601. (8 pages).

Office Action (Communication pursuant to Article 94(3) EPC) issued on Oct. 2, 2017, by the European Patent office in corresponding European Patent Application No. 12 887 301.5-1601. (5 pages).

The extended European Search Report issued Jun. 29, 2016, by the European Patent Office in European Patent Application No. 13848737.6-1601. (8 pages).

(56) References Cited

OTHER PUBLICATIONS

The extended European Search Report issued on Jun. 29, 2016, by the European Patent Office in European Patent Application No. 12886996.3-1601. (7 pages).
PCT/SE2012/051164, International Search Report and the Written Opinion Received, 12 pages.
PCT/SE2012/051164, Written Opinion Received, 6 pages.
PCT/SE2012105116, International Preliminary Report on Patentability, 7 pages.
International Search Report (PCT/ISA/210) issued on Dec. 18, 2014, by the Swedish Patent Office as the International Searching Authority for International Application No. PCT/SE2014/050518.
Written Opinion of the International Searching Authority (PCT/ISA/237) issued on Dec. 18, 2014, by the Swedish Patent Office as the International Searching Authority for International Application No. PCT/SE2014/050518.
PCT/SE2012105116, International Preliminary Report on Patentability Received, 7 pages.
English language translation of Office Action/Search Report issued on May 17, 2016, by the Russian Patent Office in corresponding Russian Patent Application No. 2015119242. (9 pages).
An English Translation of the Office Action (Decision on Grant) issued Apr. 28, 2016, by the Federal Service for intellectual Property Office in Russian Patent Application No. 2015119664/12. (6 pages).
Office Action (Non-Final) issued by the U.S. Patent and Trademark Office in the U.S. Appl. No. 15/307,313 mailed Sep. 18, 2020, U.S. Patent and Trademark Office, Alexandria, VA. (14 pages).
Notice of Granting Patent Right for Invention dated May 27, 2022, issued in the corresponding Chinese Patent Application No. 201911015648.5, 18 pages including 4 pages of English Translation.
Office Action issued on Feb. 22, 2022, by the Mexican Institute of Industrial Property (IMPI) in corresponding Mexican Patent Application No. MX/a/2016/014157, and an English Translation of the Office Action. (11 pages).
Office Action (Notification of the Second Office Action) issued on Nov. 30, 2021, by the China National Intellectual Property Administration (CNIPA) of the People's Republic of China in corresponding Chinese Patent Application No. 201911015648.5 and an English Translation of the Office Action. (16 pages).
Office Action issued on Jul. 23, 2021, by the Mexican Institute of Industrial Property (IMPI) in corresponding Mexican Patent Application No. MX/a/2016/014157, and an English Translation of the Office Action. (18 pages).
Notification of the First Office Action issued on Jun. 6, 2022, by the Chinese Patent Office in corresponding Chinese Patent Application No. 202110935259.5, and an English Translation of the Office Action. (16 pages).
Notification of the First Office Action issued on Mar. 19, 2021, by the Chinese Patent Office in corresponding Chinese Patent Application No. 201911015648.5, and an English Translation of the Office Action. (19 pages).
Notification of the Third Office Action issued on Mar. 20, 2020, by the Chinese Patent Office in corresponding Chinese Patent Application No. 201480079420.1, and an English Translation of the Office Action. (13 pages).
The extended European Search Report issued on Aug. 31, 2022, by the European Patent Office in corresponding European Application No. 21205444.9. (12 pages).

* cited by examiner

DISPENSER

CROSS REFERENCE TO RELATED APPLICATIONS

The present application is a continuation of U.S. application Ser. No. 16/946,041, filed on Jun. 3, 2020, which is a divisional of U.S. application Ser. No. 15/307,313, filed on Oct. 27, 2016, which is a U.S. national stage of International Application No. PCT/SE2014/050518, filed on Apr. 28, 2014. The entire contents of each of U.S. application Ser. No. 16/946,041, U.S. application Ser. No. 15/307,313 and International Application No. PCT/SE2014/050518 are hereby incorporated herein by reference in their entirety.

TECHNICAL FIELD

The present invention relates to a dispenser for dispensing at least one web material, the web material comprising perforation lines dividing the web material into individual products, from a storage of web material

BACKGROUND

Automatic touchfree dispensers (or "hands-free dispensers") for wipe products such as paper towels are known on the market. The hands-free dispensers are electronically manoeuvred, they store and advance the paper towel with different kinds of control devices, sensors and power sources available. Without touching the dispenser, the user can get a paper towel that is fed automatically by the electronic dispenser. Dispensers like this are commonly used in public lavatories for dispensing paper towels to users. The most common type of a powered, hands-free dispenser is a roll dispenser that users sensors to initiate the mechanisms for advancing the towel such that the subsequent sheet is presented to the user.

Rolls of paper towels are often heavy and are subject to friction and resistance when unrolling the paper. Especially when the roll is accelerated there is a high demand of energy. Consequently, there is a need for a strong paper in order to withstand the force necessary to bring a full heavy roll into rotation. A strong paper usually has drawbacks in that the softness of the paper is low. In addition, hands-free dispensers for rolled paper towels demand a large amount of space due to the relatively large volume of the heavy paper rolls.

As an alternative to rolls of paper towels, US 2011/0101020, WO 2011/045493, EP 1 830 687 all disclose dispensing units comprising a housing for holding a pile of a continuous length of accordion-like folded web of towels or other wipe products. The dispenser comprises an access opening to the pile, a dispensing opening for the web of towels, a feeding mechanism comprising a member for controlling the dispensing of the web of towels, and a drive unit. Bundles of paper towels with connecting means there between are insertable through the access opening into the housing in the dispensing unit and may be added to the bottom of the pile. The web of towels is dispensable from the upper part of the pile by the feeding mechanism, which positions the web of towels in a starting mode in the dispensing opening. This solution enables feeding of a large amount of paper towels, while avoiding the problems relating to the weight of a heavy paper roll or large pile. Preferably, the folded web material comprises a double folded perforated web material, where two perforated webs are interfolded, such that the perforations are arranged in an off-set relationship to each other. A separation unit enables the wipe products, i.e. the paper towels, to be separated at the perforation lines when the web is pulled by the user. This feature will allow the feeding of the products to be performed manually by the user, hence avoiding any additional arrangements of the dispensers such as electrical power.

However, although the previously known dispensers provide a useful alternative to roll dispensers, there remains a need for a further improved dispenser. In particular there remains a need to provide correct separation of individual products at perforation lines, to feed the next portion of the web material to be separated to the separation unit, and to present the leading end of the web material to the next user. Furthermore, it is desirable that the dispenser can separate different types of web materials and web materials having different lengths between the perforation lines.

GB 2 433 248 describes a dispenser for feeding a rolled material comprising two perforated webs, wherein the perforations are in offset relationship. The dispenser comprises two profiled rollers which are arranged to form a non-linear nip applying pressure to the sheet material and causing the perforation lines of the web material to break. The nip is formed by protrusion elements of different sizes arranged on the two rollers. It is shown that the surfaces of each pair of opposing protrusion elements are always in contact with each other.

WO 2011/1149393 describes a dispenser for feeding a rolled tissue or nonwoven material, which may be provided with perforations. A problem with perforated webs is defined, relating to the fact that the webs tend to break at every perforation, but that the user might sometimes wish to use a long section of web and sometimes a short section of web. For feeding the web in the dispenser, there is provided a drive roller and an engaging roller. The drive roller and the engaging roller are arranged such that an undulated passage is defined between the protrusion elements on the rollers. It is stated that the undulated passage ensures that the dispensing end of the web is in contact with both the drive roller and the engaging roller in the passage. Also, a pulling force exerted substantially straight out from the dispensing passage is distributed evenly over a central portion of the web, which has as result that the web will not break even if perforated, until the user chooses to apply a force sideways. The separation is thus performed by the user rather than by the dispenser itself.

Dispensers adapted for dispensing web material which is provided with perforation lines dividing the web material into individual products, and which accomplishes automatic separation of the web material along such perforation lines, are previously known in the art.

One challenge when designing such dispensers is to ensure that separation will constantly and reliably occur at every perforation line of the web material.

In manual dispensers, the separation of a product from the web material is usually initiated by a user pulling a free end of the web material, extending e.g. from a dispensing opening of the dispenser. The user might grasp and pull the free end of the web material in various manners, e.g. in a straight or inclined direction, gripping a large or a small portion of the available sheet end, pulling quickly or slowly. Preferably, the dispenser should satisfactorily separate the web material in all such different circumstances.

Moreover, the user might have wet hands when grasping and pulling the web material. This will usually affect the strength of the web material, since a wet paper towel, tissue paper or nonwoven material is generally weaker than a corresponding dry web material. Accordingly, if a user pulls the web material with wet hands, there is a risk that the web material will rupture adjacent the grip of the user. In this situation, the web material will not be properly pulled at all.

Still, using web materials with high wet strength is usually not a desired solution to the problem, since such web materials tend to be rough and unpliable, and therefore less suitable for hygienic products such as paper towels.

Instead, it is generally desired to use web materials having relatively low strength, both in wet and in dry conditions. To this end, the dispenser should be able to perform the feeding of the web material and in particular the separation of the web material into separate products with a relatively low pull force being applied by the user.

It is an object of the invention to provide a dispenser which enables reliable separation of a web material comprising perforation lines into separate products, with a relatively low pull force being applied to a free end of the web material.

In particular in public lavatories where lots of people pass, such as at airports, train stations, etc. it is desired that the dispenser shall be capable of housing a relatively large amount of web material, such that the amount of web material will be sufficient to last for a long period of time before the dispenser needs to be refilled by service staff.

Stacks of folded web material are however usually only available in relatively small sizes, e.g., 10 to 15 cm in height, which sets a limit to the available continuous length of folded web material. The reason for the limited sizes is that the stacks need to be easy to handle during refill of the dispenser.

To form a continuous web material having a greater length than what may be held in one standard-size stack, it is known to interconnect the web material ends of several such stacks, so as to form one large stack, comprising several individual stacks.

To this end, a number of different connection means have been proposed. For example, at least one end of each stack may be provided with a connection means in the form of a glue strip, for interconnecting the stack to another stack.

In the dispenser, the web material will run along a web path from a storage for the web material to a dispensing opening. Along the web path, several units may be arranged for various purposes. For example, such units may be arranged to control, stretch, cut or separate (when the web material comprises perforation lines dividing the web material into individual products) the web material.

Generally, the selection of connection means has been limited by the requirement that the connection means must be able to pass all the units provided along the web path in the dispenser, without causing trouble in the feeding of the web material, or breakage thereof. Typically, the connection means would have to have a limited height or thickness in order to be able to pass through the units along the web path without causing problems such as disruption in the feeding mechanism or web material breakage.

It is an object of the invention to provide a dispenser which diminishes the problems which may be encountered when a web material comprising connection means is to be dispensed there through. It is an additional object of the invention to enable use of a larger variety of connection means.

It is an object of the invention to provide an improved or alternative dispenser for web material, in particular for accurate and reliable dispensing of the web material.

SUMMARY

In accordance with a first aspect, one or more of the above mentioned objects are achieved by a dispenser for dispensing at least one web material comprising perforation lines dividing said web material into individual products from a storage of the web material. The dispenser comprises a housing arranged to hold the storage web material, wherein a web path extends in a feeding direction an interior of the housing from a storage position to a dispensing opening of the dispenser, and a separation arrangement is arranged along the web path, for separating the at least one web material along the perforation lines. The separation arrangement comprises a first unit and a second unit, the second unit being arranged downstream the first unit, as seen in the feeding direction of the web path.

The first unit is arranged to provide a tensioning force on the web material. The tensioning force is at least 2 N/m, preferably 4-10 N/m. The second unit is arranged to stretch the web material along a length of the web material and a width of the web material. Thereby, the web is stretched in two substantially perpendicular directions. The length of the web material corresponds to the feeding direction thereof, and the width of the web material corresponds to the dimension in the web material substantially perpendicular to the length of the web material.

The perforation lines will be arranged to extend over the width of the web material, so as to divide the web material into individual products. Advantageously, the perforation lines may be arranged to extend along straight lines perpendicular to the length of the web material.

The separation arrangement comprising the first and second unit is adapted for separating the at least one web material comprising perforation lines into individual products along the perforation lines. Accordingly, when the web material is fed out from the separation unit, it will be in the form of an individual product.

The second unit is arranged to stretch the web material along the length of the web material and along the width of the web material. Such stretching is intended to result in the web material being separated along the perforation lines. Accordingly, after passage through the second unit of the separation arrangement, the separation of the web material will be completed.

The stretching could take place in any manner resulting in a stretching in both directions, such as e.g. stretching the web material in one or more diagonal directions, or stretching strictly along the width direction and along the length direction, respectively.

It has been found, that the function of such a second unit accomplishing stretching in two directions as described in the above becomes more reliable when the web material, prior to reaching the second unit, is provided with a tensioning force. Such a tensioning force is provided by the first unit, upstream the second unit, and is to be at least 2 N/m, preferably 4-10 N/m.

Hence, the first unit and the second unit in combination provide specific advantages.

Although possibly a separation arrangement is conceivable consisting only of a second unit as described in the above, such a separation arrangement has sometimes been found to be less reliable resulting e.g. in that the web material is not always separated along each perforation line, as the web material is fed through the second unit.

When the separation arrangement comprises also a first unit providing a tensioning force as described in the above, and being arranged upstream the second unit, the reliability of separation unit is improved.

Moreover, the separation arrangement as proposed herein comprising the first and the second unit may provide for that only a relatively low pull force needs to applied by a user to a free end of the web material, in order for the user to receive an individual product from the web material. Indeed, it has been found that the pull force required by the user to obtain an individual product from the separation arrangement may be lower than a pull force required in order to obtain an individual product by manually pulling the free end of the web material without using a dispenser, e.g. when pulling the web material directly from a stack of folded web material.

The separation arrangement could possibly include other units than the first and the second unit as described in the above. However, advantageously, the separation arrangement may consist of the first and the second unit as described in the above.

Advantageously, the second unit may be arranged to simultaneously stretch the web material along the length of the web material and along the width of the web material. The second unit is arranged to stretch the web material at least along the length of the web material and along the width of the web material. To accomplish such stretching, the web material may be stretched in different longitudinal, transversal or diagonal directions in a plane comprising the web material.

In accordance with embodiments, the web material may be stretched in more than two directions, for example, it may be stretched in substantially all directions in a plane comprising the web material.

In accordance with embodiments, the web material may also be stretched in one or more directions having a component extending perpendicular to a plane comprising the web material.

According to embodiments, the second unit may provide a passage through which the web material is to pass for stretching the web material.

By "passage" is meant a gap in a structure through which the web material may pass, and which structure at least partly is to contact both opposite major surfaces of the web material, while residing in the passage. Hence, the structure may comprise some kind of members, walls or the like intended to contact the opposite major surfaces of the web material.

Advantageously, the passage may be non-linear for stretching the web material along the length of the web material and along the width of the web material. The passage being non-linear means that the web material, when residing in the passage, will be forced to to assume a non-linear shape, e.g. it may be bent, wrinkled, waved, bow shaped or undulated. To provide a non-linear passage, the structure forming the passage and which is to at least partly contact the opposite major surfaces of the web material, will accomplish said contact by members being arranged in a non-linear manner.

When moving through the non-linear passage, it will be understood that the web material may be stretched in a direction along its width. The width which the web material will assume when residing in the passage will hence be greater than the nominal width of the web material.

Many different non-linear shapes are conceivable for the passage. For example, the passage may comprise portions extending essentially parallel to the feeding direction and portions extending essentially perpendicular to the feeding direction.

According to embodiments, the non-linear passage may comprise at least two curved portions.

Advantageously, to this end, the structure may comprise some kind of members intended to contact the opposite major surfaces of the web material, wherein members arranged on the opposite sides of the structure in a staggered relationship. Hence, the members on the opposite sides of the structure are not arranged immediately opposite one another, but are offset one another.

In accordance with embodiments, the non-linear passage may be undulated. This has been shown to be particularly advantageous to accomplish reliable separation of the web material along the perforation lines.

An undulated passage may advantageously be provided by a structure with members arranged in a staggered relationship as described in the above.

Advantageously, the passage defines a minimum open gap. This means that the gap in the structure through which the web material may pass has at least a minimum size other than zero. In other words, the passage is a no-contact passage, i.e. the members intended to contact the web material passing through the passage will not contact each other when no web material is present in the passage. Hence, the web material may pass through the passage without being pressed or nipped.

In accordance with embodiments, the second unit may define a minimum open gap for passage of the web material.

In accordance with embodiments, the second unit may be adjustable for adjusting the size of the minimum open gap.

When the size of the minimum open gap is adjustable, the separation arrangement is rendered more adaptable to different web materials and perforation lines. Especially, the separation arrangement is adaptable to a wider range of different intermittent thickness variations.

According to embodiments, the second unit may be arranged to be resilient such that the passage is automatically adaptable to intermittent thickness variations in the web material passing through the passage.

Intermittent thickness variations in the web material passing through the passage might be caused e.g. by connection means which are provided between individual web sections so as to interconnect the web sections to one continuous web material. The presence of such connection means along the web material may result in an intermittent increased thickness of the web material at regular intervals.

The second unit being resilient means that the passage, preferably the size of the minimum open gap thereof, may be automatically adjustable to such intermittent variations in the thickness. E.g. the minimum open gap may expand when a connection means enters in the gap, and then reassume its original size when the connection means has passed the gap. Thereby, the dispenser enables the use of a larger variety of different connection means.

According to embodiments, the second unit may comprise at least a first and a second portion between which the passage is formed, and the first and/or second portion may be resiliently arranged so as to be automatically adaptable to intermittent variations in the thickness of the web material passing through the passage.

According to embodiments, the first unit may be arranged to provide an adjustable tensioning force onto the web material, preferably the tensioning force is adjustable between 2 and 20 N/m, preferably between 4 and 10 N/m.

When the tensioning force is adjustable, the separation arrangement is rendered more adaptable to different web materials and perforation lines, such that reliable separation of the web material may be accomplished in a variety of circumstances.

According to embodiments, the first unit may comprise at least a contact element arranged to contact the web material so as to provide the tensioning force.

Such a contact element may provide a tensioning force by means of friction.

According to embodiments, the first unit may comprise at least a support element for supporting the web material, and a contact element, being arranged to contact the web material when resting over the support element so as to provide the tensioning force. According to embodiments, the tensioning force provided by the first unit may comprise the force of gravity acting on the mass of the contact element. Preferably, the tensioning force provided by the first unit is primarily the force of gravity acting on the mass of the contact element.

Hence, the contact element resting freely on the web material gives rise to a tensioning force being dependent on the mass of the contact element. By primarily is meant that the gravity is the major cause for the tensioning force. However, it is not excluded that the tensioning force might include components coming from other sources.

For example, at least 80%, preferably at least 90% of the tensioning force may originate from the force of gravity acting on the mass of the contact element.

According to embodiments, the contact element may comprise at least one removably mounted mass component. The mass of the contact element may be adjustable to adjust the tensioning force exerted by the first unit on the web material.

Hence, the tensioning force may be adjusted by selection of a mass with a size giving rise to a suitable tensioning force.

According to embodiments, the first unit may be arranged to be resilient such that the first unit is automatically adaptable to intermittent thickness variations in the web material.

According to embodiments, the first unit may comprise a passage for the web material, which passage is arranged to be resilient such that the first unit is automatically adaptable to intermittent thickness variations in the web material.

The advantages obtained by the first unit being arranged to be resilient are the same as those described in the above in relation to the second unit.

Preferably, both the first and the second unit are arranged to be resilient.

According to embodiments, the contact element may be spring biased towards the web material.

According to embodiments, the web material is to be dispensed from a stack of web material, and the housing is arranged to hold a stack of web material, such that the web path extends from the top of the stack.

In accordance with a second aspect, one or more of the above mentioned objects may be achieved by a dispenser for dispensing at least one web material, comprising perforation lines dividing the web material into individual products, from a storage of the web material. The dispenser comprises a housing arranged to hold the storage of web material, wherein a web path extends along a feeding direction in an interior of the housing from a storage position to a dispensing opening of the dispenser. A separation arrangement is arranged along the web path, for separating the at least one web material along the perforation lines thereof. The separation arrangement comprises a first unit and a second unit, the second unit being arranged downstream the first unit, as seen in the feeding direction of the web path. The first unit is arranged to provide an adjustable tensioning force onto the web material, and the second unit is arranged to stretch the web material along the length of the web material and along the width of the web material.

The above-mentioned second aspect may be combined with any of the features as mentioned in the above in relation to the first aspect.

In accordance with a third aspect, one or more of the above mentioned objects may be achieved by a dispenser for dispensing at least web material, comprising perforation lines dividing the web material into individual products, from a storage of the web material. The dispenser comprises a housing comprising the storage of the perforated web material, wherein the web material extends in a feeding direction along a web path in the interior of the housing from a storage position to a dispensing opening of the dispenser. A separation arrangement is arranged along the web path, for separating the at least one web material along the perforation lines. The separation arrangement comprises a first unit and a second unit, the second unit being arranged downstream the first unit, as seen in the feeding direction of the web path.

A first pull force is arranged to pull the web material downstream the first unit, and a second pull force is arranged to pull the web material downstream the second unit. The first pull force is 10 to 50% of the second pull force, preferably 20 to 50%, more preferably 20 to 40%, preferably 30 to 40%.

It has been found, that the arrangement providing a distribution of the pull forces downstream the first unit and downstream the second unit as described in the above renders the separation of the web material more reliable. This is believed to be connected to the first unit pre-tensioning the web material before the web material arrives at the second unit.

Hence, the first unit and the second unit in combination provide specific advantages as has already been mentioned in the above in relation to the first aspect.

It is to be understood that the first pull force is measured downstream of the first unit, and upstream of the second unit. Hence, it reflects the influence of the first unit, but not of the second unit. The second pull force is measured downstream the second unit and the first unit. Hence, it reflects the influence of the first unit and of the second unit.

Surprisingly, it has been found that the distribution of pull forces as described in the above results in the pull force downstream the second unit, being the force with which a user will need to pull a free end of the web material as to obtain an individual, separated product from the web material, being relatively low.

In particular, the pull force downstream the second unit in the proposed separation arrangement may be lower than the pull force measured downstream a similar second unit in isolation, i.e., without a first unit.

Moreover, the second pull force may be less than the perforation strength of the perforation lines of the web material. The perforation strength measures the pull force required to manually separate a sheet from the stack, when the stack is resting freely, as will be described in more detail in the below.

Advantageously, the separation arrangement may consist of the first and the second unit as described in the above.

According to embodiments, the first pull force may be greater than 0.5 N, preferably greater than 0.7 N, most preferred greater than 1 N.

According to embodiments, the second pull force may be less than 8 N, preferably less than 6 N, and most preferred less than 4 N.

Hence, pull forces enabling separation of a product from a web material which are relatively low in comparison with what is generally required in the prior art are achieved.

According to embodiments, the storage of web material is in the form of a stack.

According to embodiments, the web material may comprise a first web divided into individual products defined between subsequent perforation lines extending over a width of the first web.

According to embodiments, the web material may comprise at least a second web divided into individual products defined between subsequent perforation lines extending over a width of the second web. The first and second webs are then interfolded so that the perforation lines of the first web are offset from the perforation lines of the second web in a length direction of the first web.

Such a web material comprising at least a first and a second web with the perforation lines of each web being arranged in an offset manner is advantageous in that it enables automatic feeding of a free end of the second web, upon pulling and separating the first web. Hence, alternative feeding of products from the two webs is provided.

According to embodiments, the web material may comprise a plurality of individual web sections, the web sections being interconnected by connecting members, preferably the connecting members comprises hook- and loop interconnections.

The web material as described in the above may be used together with the dispenser according to any of the aspects presented herein.

According to embodiments, the first and/or second unit are arranged to be resilient so as to be automatically adaptable to intermittent thickness variations in the web material. Such intermittent variations in the thickness may be caused by connecting members between web sections.

The above-mentioned third aspect may be combined with features as mentioned in the above in relation to the first and/or second aspect.

In accordance with a fourth aspect, one or more of the above mentioned objects may be achieved by a dispenser for dispensing at least one web material from a storage of web material. The dispenser comprises a housing arranged to hold the storage of web material, wherein a web path extends along a feeding direction in an interior of the housing from a storage position to a dispensing opening of the dispenser. At least two units, e.g. a first and a second unit, each unit defining at least one passage for the web material, are arranged along the web path.

The at least two units are arranged to be resilient such that their respective passages are automatically adaptable to intermittent thickness variations in the web material.

The web material may be a web material as described above.

The intermittent thickness variations are defined to be the differences between a nominal web material thickness and the thickness obtained by intermittently occurring deviations from the nominal web material thickness e.g. at a connection between web sections.

Hence, the intermittent thickness variations are herein to be of a size greater than what may be expected as normal thickness variations of a nominal thickness of the web material, due e.g. to manufacturing irregularities in the web material.

Intermittent thickness variations in the web material will be caused e.g. by the passage of connection means between separate web sections. Such connection means may result in an intermittently increased thickness of the web material at regular intervals, corresponding to the length of the web sections and hence to the size of the original stacks before interconnection thereof. The units being resilient mean that they are automatically adjustable to such intermittent variations in the thickness.

For example a gap or nip portion may expand when a connection means enters the gap or nip, and then reassume its original size when the connection means has passed the gap or nip. Accordingly, the passage of connection means through the units along the portion of the web path is facilitated. Also, the increased adaptability to intermittent thickness variations in the web material may enable the use of new types of connection means, for example connection means having a greater height or a greater stiffness than previously used connection means.

According to embodiments, the units are arranged to be resilient so as to be automatically adaptable to intermittent thickness variations of at least 0.5 mm, preferably between 0.5 and 2 mm, most preferred between 0.5 and 4 mm.

According to embodiments, the first and second unit may be comprised in a separation arrangement being arranged along the web path, for separating the at least one web material along the perforation lines thereof.

According to embodiments, the second unit may be arranged downstream the first unit, as seen in the feeding direction of the web path.

According to embodiments, at least one unit may be resilient by means of the unit comprising biasing elements. Biasing elements, e.g. springs, are suitable for enabling resilient units.

According to embodiments, at least one unit may be resilient by the unit comprising a contact element resting freely on the web material of the web path, the contact element providing a tensioning force primarily by force of gravity acting on the mass of the contact element. A contact element having a certain weight resting on the web material may also be a suitable manner for obtaining a resilient unit.

According to embodiments, the dispenser comprises at least one additional unit arranged along the web path, and all units of the dispenser are arranged to be resilient so as to be automatically adaptable to intermittent thickness variations in the web material. In this case, the entire dispenser will be adaptable to intermittent thickness variations.

In this case, the entire dispenser will be particularly adapted to web materials comprising intermittent variations, and an improved function may be achieved.

According to embodiments, the dispenser may comprise web material arranged to extend along the web path.

According to embodiments, the storage of web material may be in the form of a stack. Preferably, the web path extends from the top of the stack.

According to embodiments, the web material may comprise a first web divided into individual products defined between subsequent perforation lines extending over a width of the first web.

According to embodiments, the web material may comprise at least a second web divided into individual products defined between subsequent perforation lines extending over a width of the second web, and wherein the first and second webs are interfolded so that the perforation lines of the first web are offset from the perforation lines of the second web in a longitudinal direction of the first web.

According to embodiments, the web material comprises a plurality of individual web sections, the web sections being interconnected by connecting members providing said intermittent thickness variations to the web material, preferably the connecting members comprises hook- and loop interconnections.

It is to be understood that various features and embodiments of the different aspects above may be combined with each other.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1:
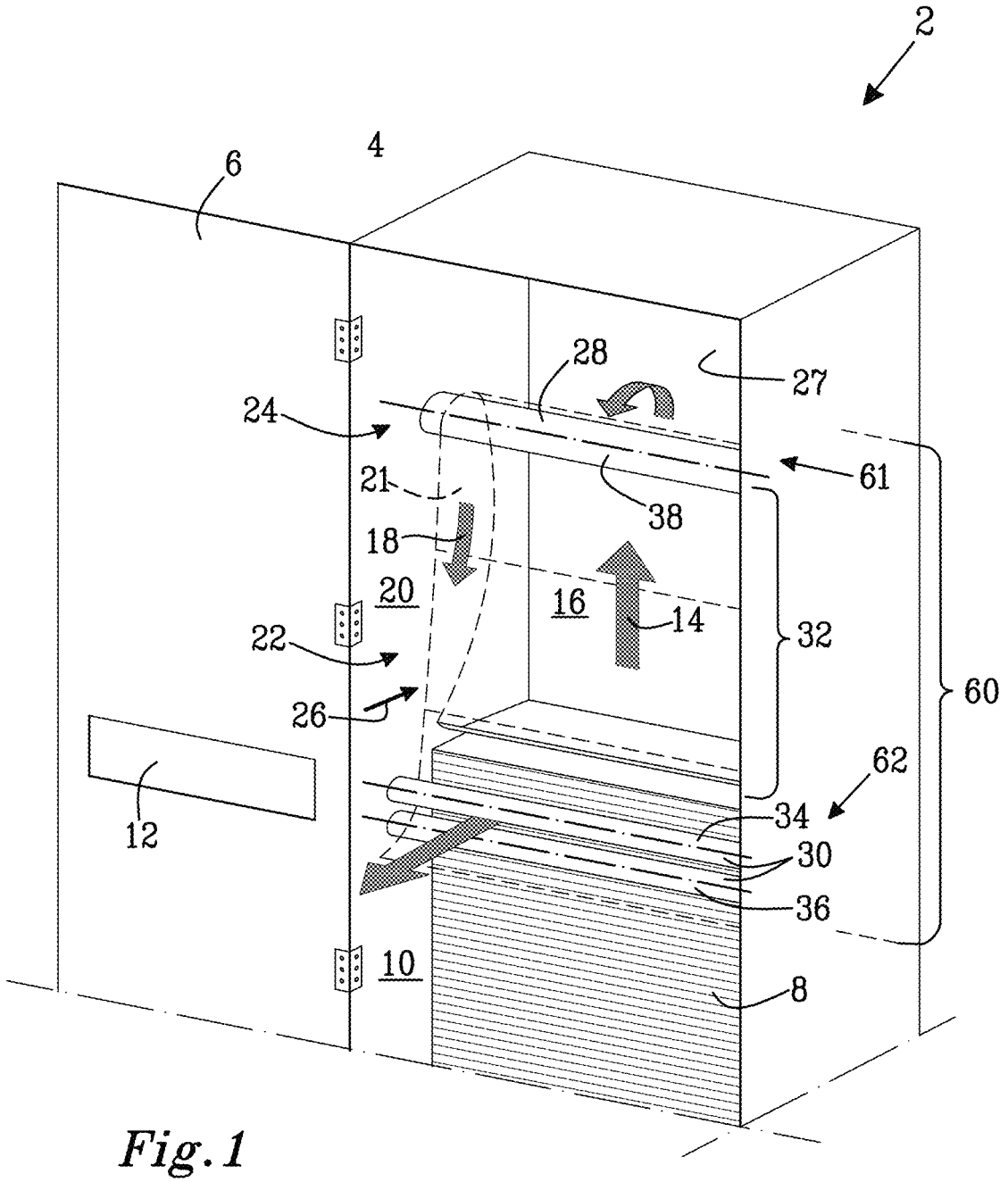
FIG. 1 illustrates a dispenser according to embodiments.
Figure 5:
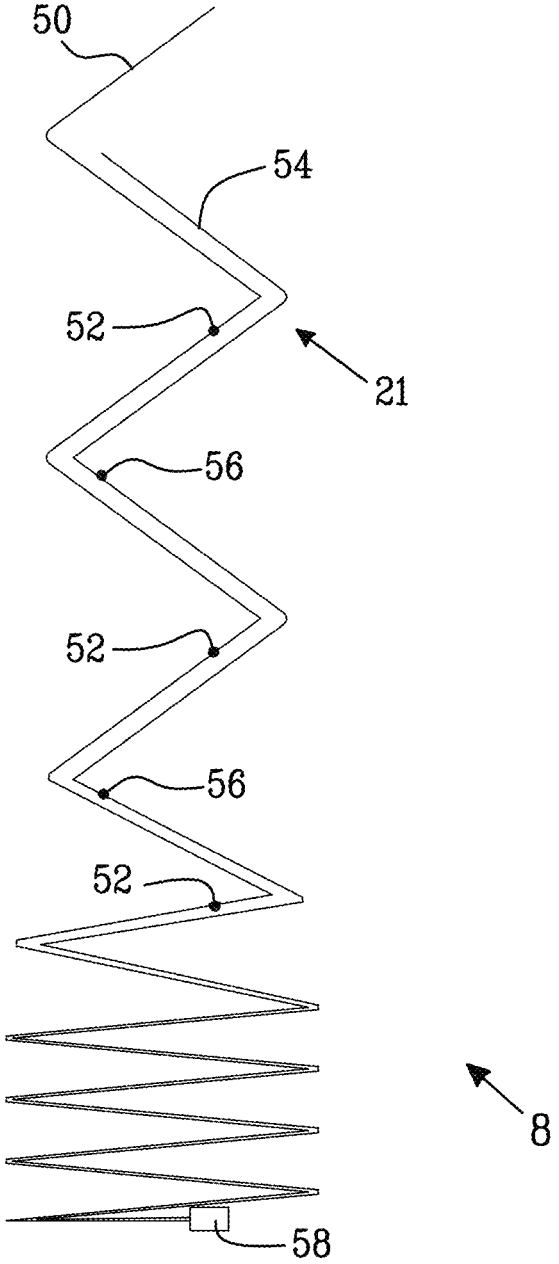
FIG. 5 illustrates schematically a cross section through a stack of web material according to embodiments.

FIG. 1 illustrates a dispenser 2 according to embodiments. The dispenser 2 comprises a housing 4, which housing 4 comprises a door 6. The door 6 is illustrated in an open position to reveal an interior of the housing 4. The dispenser 2 is arranged for dispensing web from a stack 8 of web material. Accordingly, the housing 4 is arranged to hold the stack 8 of web material. The stack 8 comprises continuous web material which is Z-folded in an accordion-like manner. The web material comprises a first web, which may be divided into individual products defined between subsequent perforation lines, extending over a width of the first web. The stack 8 may be a stack as illustrated in FIG. 5.

In an interior of the housing 4, a web path extends from a stack position 10 to a dispensing opening 12 of the dispenser 2. The stack position 10 in the housing 4 is a portion of the housing 4 adapted to hold the stack 8 of web material. Accordingly, the stack position 10 extends over the portion adapted to hold the stack 8, from the top of the stack 8 when the dispenser 2 has been newly replenished with web material, as illustrated in FIG. 1, to a stack supporting lower surface inside the housing 4 when nearly all the web material has been dispensed from the stack 8. The dispensing opening 12 is arranged in the door 6 of the housing 4.

In the illustrated embodiment, the web path extends in a first direction 14 in a first portion 16 of the housing 4 and in a second direction 18 in a second portion 20 of the housing 4. The first direction 14 is directed substantially opposite to the second direction 18. The web path has been illustrated with broad arrows, and a tail 21 of the web material extending along the web path has been illustrated with broken lines, in FIG. 1.

The housing 4 comprises an access opening 22 in a first side portion 24 of the housing 4. The access opening 22 provides access to the interior of the housing 4. The door 6 is arranged to open and close the access opening 22. The web path is accessible along a third direction 26, in both the first and second portions 16, 20 of the housing 4, via the access opening 22. Thus, an attendant may open the door 6 to access the access opening 22 and the interior of the housing 4, e.g. for replenishing the dispenser 2 with a stack 8 of web material and/or for threading the tail 21 of web material from the stack position 10 along the web path to the dispensing opening 12. The third direction 26 is substantially perpendicular to the first and second directions 14, 18.

Seen in a direction from the access opening 22, i.e. in the third direction 26, the first portion 16 of the housing 4 is arranged after the second portion 20 of the housing 4. The first portion 16 of the housing 4 is arranged adjacent to a first wall 27 of the housing 4. The first wall 27 is arranged opposite to the access opening 22. The second portion 20 of the housing 4 is arranged adjacent to the access opening 22.

Although the arrangement of the web path as described in the above provides advantages, it is not necessary to obtain the advantages of the aspects of the invention. Instead, other arrangements of web paths may be conceivable, for example where the web path run in only one direction, or in two directions not being opposite to one another.

An arrangement for dispensing the web material is arranged along the web path. The arrangement may be adapted such that passages thereof, through which the web passes, may be automatically adjusted in accordance with intermittent thickness variations in the web material. The arrangement may further be arranged such that a correct tension, web stretch and pull force is maintained irrespective of the presence of intermittent variations in web material thickness.

In the dispenser 2 illustrated in FIG. 1, the arrangement comprises a first support element 28 for the web material and a second support element 30 for the web material. Part of the web path extends between the first and second support elements 28, 30 and over the first support element 28. The first direction 14 extends from the stack position 10 to the first support element 28, and the second direction 18 extends from the first support element 28 to the second support element 30. The web path is accessible at a level 32 defined between the first support element 28 and the second support element 30, in both the first and second portions 16, 20 of the housing 4, via the access opening 22.

The first and second support elements 28, 30 are comprised in a separation arrangement 60 for separating an individual product of web material from the tail 21 of the web material. The separation arrangement 60 comprises a first unit 61 and a second unit 62, which is arranged downstream of the first unit 61. The first and second units 61, 62 are adapted to cooperate in order to provide the desired dispensing of individual web products through the dispensing opening 12.

The first unit 61 comprises the first support element 28, which in turn comprises a first roller 38. The first roller 38 may be resiliently arranged, by being pivotally suspended in the housing 4. It may also be biased, e.g. by spring biasing, thereby biasing the first roller 38 toward a default position. Thereby, the first roller 38 may be deflected during forces provided between the first roller 38 and the web material as the web material moves along the web path. The first roller 38 may be directly or indirectly suspended in the housing 4. The first unit 61 is configured to provide a tensioning force on the web material. The tensioning force prevents the web material 8 from moving backwards towards the stack position 10, or in a lateral direction during, the use of the dispenser or in case of web-breakage. Moreover, the tensioning force provides a pretension to the web material 8 before reaching the second unit 62. In the embodiment illustrated in FIG. 1, the tensioning force may be realized by friction between the surface of the first roller 38 and the web material, and by the inertia of rotation of the first roller 38. The first roller 38 may be provided with a coarse or rough surface, such as to provide a friction against the web material high enough to provide a desired tensioning force. Such a coarse surface may be a provided by mechanically or chemically modifying the surface of the roller or by applying a coating thereto. The first roller 38 may also be arranged such as to have a resistance against rotation thereof, especially in a direction opposite the intended direction of movement of the web material 8 along the web path.

The second unit 62 of the separation unit 60 comprises the second support element 30. The second support element 30 comprises a second roller 34 and a third roller 36. A passage for the web material is formed between the second and third rollers 34, 36. The second and third rollers 34, 36 are arranged relative each other with a gap there between, such as not to contact each other. Thereby, the web material will substantially not be nipped or pressed during passage through the gap. However, the second and third rollers 34, 36 are arranged to contact the web material as it passes through the passage, such as to stretch the web material along its length and width.

The second and third rollers 34, 36 may be resiliently arranged, by being pivotably suspended in the housing 4. They may be directly, or indirectly, suspended in the housing 4. By the resilient arrangement of the second and third roller 34, 36 the passage for the web material is automatically adaptable to webs of different thicknesses, as well as to intermittent variations in the thickness of the web. Thereby the web material is stretched upon passage through the passage, also at the regions comprising the intermittent thickness variations or adjacent to regions comprising the intermittent thickness variations.

The second and third rollers 34, 36 may be biased, e.g. by use of biasing elements, such as springs (not illustrated). Thereby, the second and third rollers 34, 36 may be biased toward each other by springs, such as to form a default size of the gap forming the passage. By the spring biasing, the gap between the rollers changes automatically as the thickness of the web material passing through the gap varies.

Figure 2:
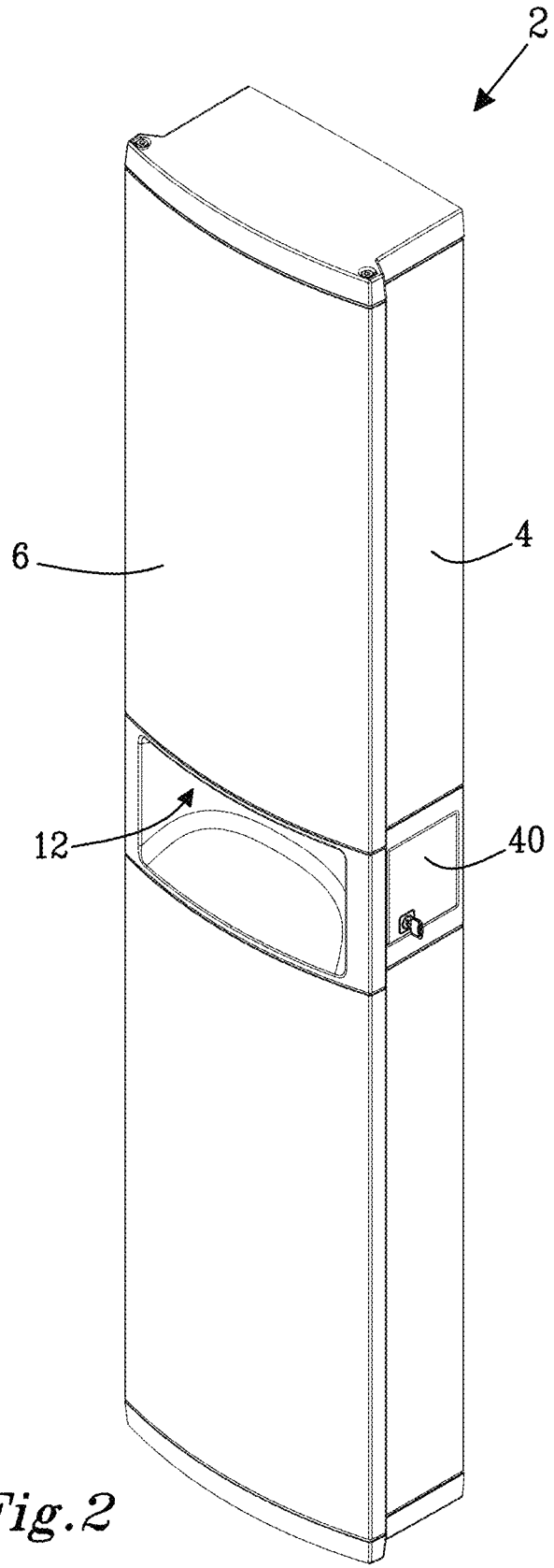
FIG. 2 illustrates a dispenser for dispensing web material according to embodiments.

FIG. 2 illustrates a dispenser 2 for dispensing web material according to embodiments. The dispenser 2 comprises a housing 4, and the housing 4 comprises a door 6. In the door 6, a dispensing opening 12 is provided for dispensing the web material. The door 6 is arranged for opening and closing an access opening to an interior of the dispenser 2. The door 6 may be locked in a closed position by means of a locking arrangement 40.

Figure 3:
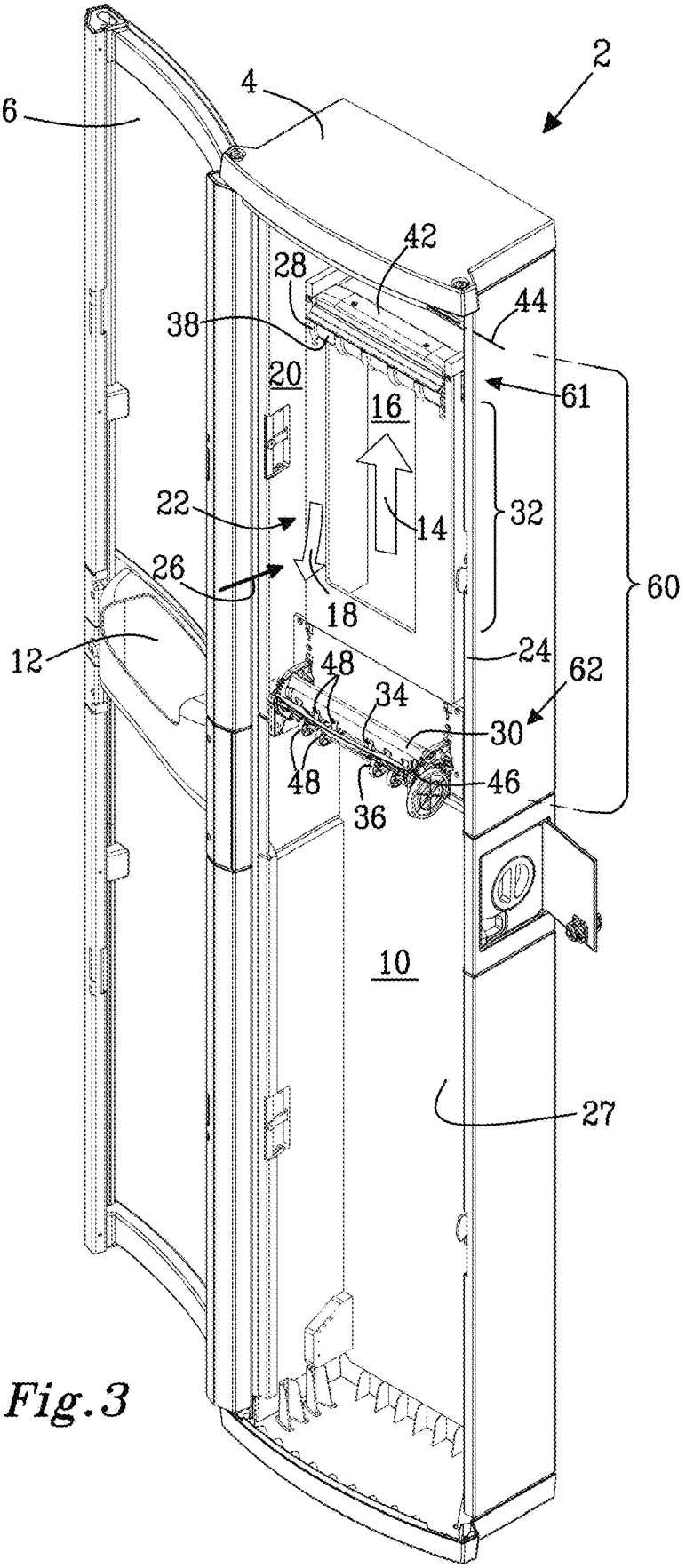
FIG. 3 illustrates the dispenser of FIG. 2 with a door in an open position.

FIG. 3 illustrates the dispenser 2 of FIG. 2 with the door 6 in an open position. Again, the dispenser 2 is arranged for dispensing web material from a stack of continuous web material which may be Z-folded in an accordion-like manner, for example as illustrated in FIG. 5 and as described in detail below. The stack has been omitted in FIG. 3 for clarity reasons. However, from a stack position 10 a web path extends to the dispensing opening 12 of the dispenser 2. The stack position 10 is arranged in a lower portion of the housing 4. The housing 4 comprises an access opening 22 in a first side portion 24 of the housing 4. The access opening 22 provides access to the interior of the housing 4. The web path is accessible along a third direction 26, in both the first and second portions 16, 20 of the housing 4, via the access opening 22. The web path extends in a first direction 14 in a first portion 16 of the housing 4 and in a second direction 18 in a second portion 20 of the housing 4. The first direction 14 is substantially opposite to the second direction 18. The first direction 14 extends from the stack position 10 to a first support element 28, and the second direction 18 extends from the first support element 28 to a second support element 30.

Although the arrangement of the web path as described in the above provides advantages, it is not necessary to obtain the advantages of the aspects of the invention. Instead, other arrangements of web paths may be conceivable, for example where the web path run in only one direction, or in two directions not being opposite to one another.

In the dispenser illustrated in FIG. 3, the arrangement comprises a separation arrangement 60, which is arranged along the web path. The separation arrangement 60 comprises a first unit 61 and a second unit 62, each of which will be described in more detail below. The second unit 62 is arranged downstream of the first unit 61, seen in the direction of the web path indicated by the arrows 14, 18. Due to the separation arrangement 60, the web material is separated along its perforation lines when the user pulls the web tail protruding from the opening 12. As described above, the first and second units 61, 62 cooperate to feed the web material and separate individual products along the perforations. The first unit 61 will provide a tensioning force on the web material, and the second unit 62 will stretch the web material substantially simultaneously along the length of the web material and along the width of the web material as the web material passes through the separation unit 60, such that the web material may be properly separated by the consumer. The tensioning force may be at least 2 N/m, and may be adjustable, as described below. By configuring the first unit 61 such as to provide an adjustable tensioning force, the pull force required to separate the web material along the perforation lines may also be adjusted. The dispenser may thereby be used together with different types of web material.

The first unit 61 and the second unit 62, according to the embodiment illustrated in FIG. 3, will be described in detail.

The first unit 61 comprises the first support element 28 and a contact element 42, which is arranged to contact the web material in order to provide the tensioning force. The first support element 28 comprises a first roller 38 pivotably suspended inside the housing 4, similar to the first roller 38 described with reference to FIG. 1. The contact element 42 is pivotably arranged inside the housing 4 and arranged to pivot towards the first support element 28 about a pivot axis 44. The contact element 42 may be arranged such that it can be displaced such that no part of it bears against the web supporting surface of the first roller 38 during feeding of the web material 8 in the dispenser 2. Thereby, it may be ensured that an attendant will thread a tail of web material from the stack position 10 over the first support element 28 and under the contact element 42, i.e. through the nip formed there between. After the web material 8 has been fed into the dispenser 2, along the web path, the contact element 42 may be returned to its default position, to provide the tensioning force.

The contact element 42 abuts against the first support element 28, also when no web material extends along the web path. The contact element 42 extends substantially from a first wall 27 of the dispenser 2 to the first support element 28. The first wall 27 is arranged opposite to the access opening 22. The first axis 44 extends along the first wall 27. A nip formed by the first support element 28 and the contact element 42 may hold a tail of the web material and prevent the tail of the web material from sliding backwards towards the stack position 10, due to the tensioning force exerted on the web material by interaction of the first roller 38 and the contact element 42. The contact element 42 may be arranged to pivot towards the first support element 28 from above. Thereby the contact element 42 comes into contact with the web material due to gravity, and the tensioning force exerted by the contact element 42 is primarily provided by the weight of the contact element. The contact element 42 may be adapted such that one or more masses may be removably mounted thereto.

Figure 4A:
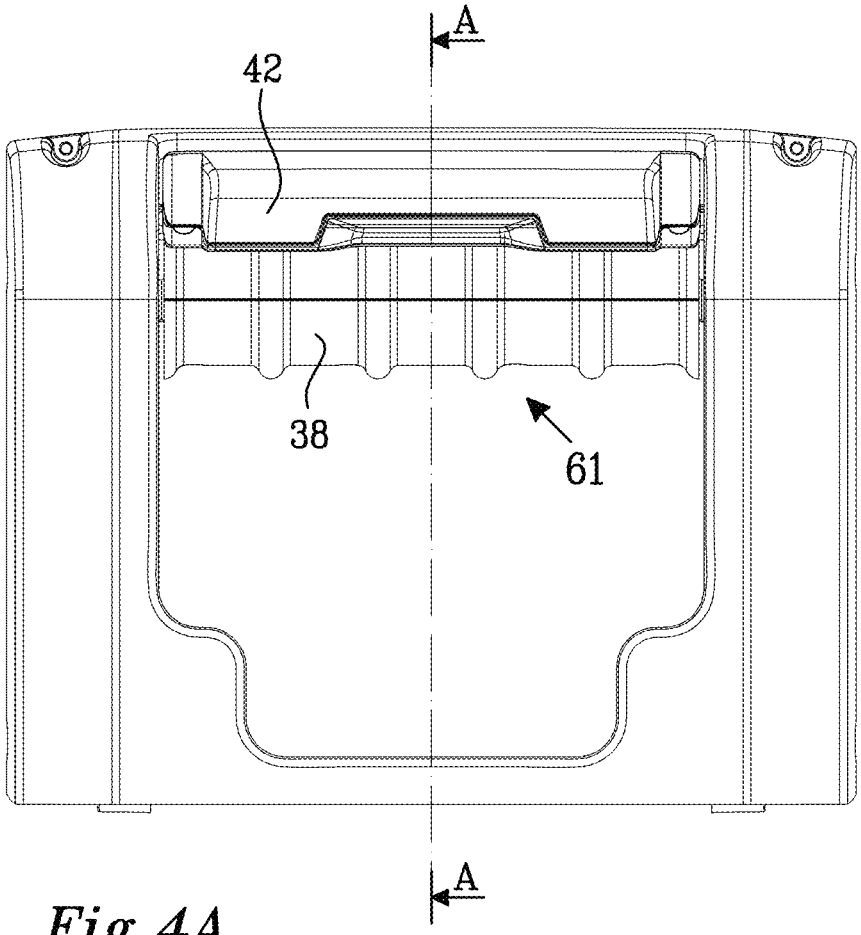
FIGS. 4A-4B illustrate details of the dispenser according to embodiments.
Figure 4B:
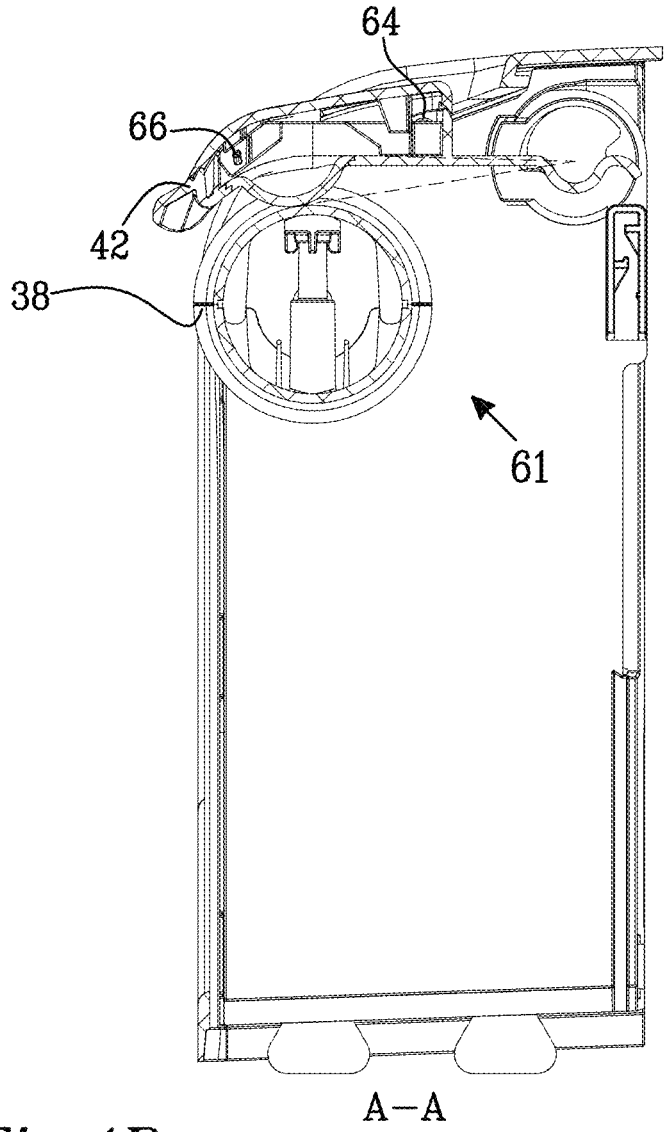

FIGS. 4A-4B illustrate a detail of the first unit 61. FIG. 4B shows a cross section taken along the line A-A of FIG. 4A. FIG. 4B illustrates a first and a second position 64, 66 where masses may be mounted. By choosing the weight of the masses the magnitude of the tensioning force provided by the first unit 61 may be selectively adjusted.

Alternatively, or additionally the contact element 42 may be spring biased against the first roller 38. Thereby, the first unit 61 is resiliently arranged, such that it is automatically adaptable to intermittent variations in the thickness of the web material. By the pivoting, eventually spring biased arrangement of the contact element 42 and the first roller 38 the nip formed there between is automatically adjusted to intermittent variations of the thickness of the web material.

Further, either one or both of the first roller 38 and the contact element 42 may be provided with a coarse surface, which will also contribute to the tensioning force due to friction formed between the coarse surface and the web material. Such a coarse surface may be a provided by mechanically or chemically modifying the surface, i.e. the underside of the contact element 42, or by applying a coating thereto.

By adjusting the tensioning force provided by the contact element 42, the web material may be held with sufficient tension in relation to the second unit 62, such that the second unit 62 may properly stretch the web material and enable dispensing a suitable length of web material 8.

Due to the tensioning force, the web material 8 will be pre-tensioned before reaching the second unit 62. The contact element 42 may also ensure that the interfolded webs will not become displaced with respect to one another as they pass through the dispenser 2.

The tensioning force will provide a braking force on the web material 8 and thereby provide resistance when a user pulls the web material 8 out of the dispensing opening 12. The first unit 61 thereby contributes to the pull force required to be applied by a user in order to pull a portion of the web material out of the dispensing opening.

The second unit 62 comprises the second support element 30. The second support element 30 comprises a separation unit 46 adapted for separating an individual product from the web material coming from a stack of web material 8 inside the dispenser 2. The separation unit 46 is adapted for separating an individual product from a web material comprising perforation lines dividing the web material in to the individual products. The separation unit 46 comprises a second roller 34 having a second rotation axis and a third roller 36 having a third rotation axis. The second and third rotation axes extend in parallel with each other. A passage for the web material is formed between the second and third rollers 34, 36. Similar to the second unit 62 described with reference to FIG. 1, the second and third roller 34, 36 are arranged such that they are not in contact with each other. The passage has a minimum open gap.

The second and third rollers 34, 36 are arranged such that the distance between their respective rotational axes is adjustable. Hence, the size of the minimum open gap of the passage is adjustable.

Similar to the first roller 38 described above, one or both of the second and third roller 34, 36 are pivotally arranged, and are preferably biased in directions toward one another, for example by spring biasing. The second unit 62 is thereby resilient, such that the passage for the web material may automatically adapt to intermittent thickness variations in the web material. Especially, the size of the open gap will be automatically adjusted to intermittent thickness variations in the web material passing through the passage.

The second and third rollers 34, 36 are provided with protrusion elements 48 spaced along the first and second rotation axes. In the illustration of FIG. 3, each of the second and third roller 34, 36 is provided with a plurality of protrusion elements 48. However, it would also be possible that the second and third rollers be provided with corresponding shapes such as to form other shapes, such as to thereby stretch the web material along its width.

The protrusion elements 48 may be integral with the rollers 34, 36, or may be separate elements attached to the rollers. The protrusion elements 48 may be made of a material, such as rubber or another elastomeric material, providing friction between their outer portions and the web material. Outer portions of the protrusion elements 48 on the second roller 34 overlap partially with outer portions of the protrusion elements 48 on the third roller 36 with a radial overlap length forming an undulated passage for a web material between the second and third rollers 34, 36. The radial overlap length may be between 2-40 mm, preferably 2-20 mm, more preferably 3-12 mm, or most preferably between 4-10 mm. Thereby an undulating passage for a web material may be formed between the second and third rollers 34, 36 such that the shape of the passage for a web material formed between the protrusion elements is meandering along an imaginary line extending along a width direction. The undulated passage forms a friction nip, in which the second and third rollers 34, 36 engage frictionally with the web material passing there through. Due to the frictional engagement of the web material, a sheet of web may be separated from the tail of web material in the separation unit 46 along a perforation of the web material as a user pulls on the web material to dispense a sheet of web.

Due to the adjustable distance between the rotational axes of the second and third rollers the radial overlap length in the undulating passage is variable. The distance between the rotational axes may be chosen such that an undulating passage providing an optimal pinch force is achieved depending on the type of the web material.

The protrusion elements may be of any suitable shape. Thus, the protrusion elements may be in the form of disc elements, propeller-shaped elements, cylinder elements or the like. The cross-section in a radial plane of the protrusion elements may be rounded at the outer periphery of the protrusion element. The cross-section at the outer periphery of the protrusion element may also be rectangular, triangular, wavy or the like. The protrusion elements may be covered by a sleeve or ring of an elastomeric material encircling the outer periphery of each individual protrusion element. The elastomeric material may be glued, vulcanized or simply stretched around the outer portion of the protrusion element.

The maximum radial extensions of the protrusion elements may be equal to or greater than the widths of said protrusion elements. The more the difference between the maximum radial extensions and the widths of the protrusion elements, the greater the undulation amplitude of the passage formed between the protrusion elements. This, in turn, means that with increasing undulation amplitude the pinch force increases. The spacing of the protrusion elements may be the same along the width direction of the first and/or said second roller. Also, the spacing of the protrusion elements may vary along the width direction of the first and/or said second roller. That is, the protrusion elements may be uniformly or non-uniformly distributed along the first and/or second roller. Thus, the protrusion elements may be sparsely arranged in the central portion of the rollers, and concentrated in the peripheral portions of the rollers. If such an arrangement is used, a wrinkleless portion of the web material in the central portion of the roller may be more suitable for gripping by the user when the web material is to be separated.

In the dispensers described above and illustrated in FIG. 1-4B, the first unit 61 and the second unit 62 of the separation unit 60 are adapted such as to cooperate to enable proper dispensing of individual sheet of web material, with proper tearing of the web along perforated lines, while at the same time a relatively low pull force needs to be applied to a free end of the web. The first unit 61 and the second unit 62 both contribute to the pull force required to pull web material out of the dispensing opening 12. The first unit 61 is arranged to contribute a resistance force against movement of the web material which has to be overcome by a first pull force required to pull the web material downstream of the first unit 61. This first pull force is influenced by parameters such as the rotational friction of the third roller 38, the surface friction causing friction between the surface of the third roller 38 and the magnitude of the tensioning force provided by the first unit 61.

A second pull force is defined as the pull force required for pulling the web material downstream the second unit 62. Therefore, both the first and the second units 61, 62 influences the magnitude of the second pull force. The first unit 61 contributes to the first pull force as defined above. The second unit 62 contributes to the second pull force by e.g. its relative position with respect to the first unit 61 and by the specific arrangements of the components of the second unit 62, such as the rotational friction of the second and third rollers 34, 36, the friction between the web material and the protruding elements 48, and the size of the gap allowing passage of the web material. Thereby, the first and second units 61, 62 cooperate to have a combined effect to the dispensing mechanism of the web material.

The separation unit 60 is adapted such that the first pull force is in the range of 20 to 50% of the second pull force. Preferably, the first pull force is 30 to 40% of the second pull force. The second pull force is less than 6N, preferably less than 5N, most preferred less than 4N, and is thereby less than the pull force required to manually separate a sheet from the stack, when the stack is resting freely.

Thus, by using the separation unit according to the present invention, the risk that any given preformed perforation line would break before that particular perforation line has reached the dispensing opening is reduced. At the same time, the separation unit according to the present invention facilitates the separation of the web material such that the force needed for separation of the web material is reduced.

The first and second pull forces are defined as measured according to a pull force measurement method as follows, for web material comprising perforation lines dividing the web material into individual products, e.g. as illustrated with reference to FIG. 5, in the dispenser illustrated with reference to FIG. 3. Also, the perforation strength of the web material, i.e. the strength of the perforation lines, may be measured according to the method as follows.

Force Gauge used: Mecmesin BFG 50 N

Clamp, small (3×1 cm)

General Description of Method

The method is to be performed in an environment with 50% RH, at 23° C. The web material is to be conditioned in this environment for 24 hours before the method is performed. For further information, reference is made to the ISO-187 standard.

Always attach the clamp (about 1 cm from the edge of the refill) and then pull the refill by at an even speed similar to the speed used when dispensing (~1 m/s). The force Gauge should be set to register the maximum force during the pull. Do 10 tests in the same way and note the values. Note any tabbing or tearing or failures that may occur. Always zero the instrument before measuring.

1. Measure the perforation strength of the web material.
   a. Place the web material on a smooth flat surface. To lock the web material in place, put a weight (or clamp) on the web beyond a first perforation line. Attach the clamp and zero the force gauge, then pull slowly (~1 m/s). Register the maximum force which is reached when a perforation line breaks.
   b. Move the web material forward and put the weight beyond the next product. Then attach the clamp and pull in the same manner as before and register the maximum force when the next perforation line breaks.
   c. Repeat the above steps until you have at least 10 recorded perforation strengths. Calculate the average perforation strength.
2. Measure the pull force downstream the first unit
   a. Arrange the web material in the dispenser, along the web path so as to extend through the first unit.
   b. Measure downstream the first unit and upstream the second unit by attaching the force gauge clamp to the web material, zero the instrument and pull straight down about 50 cm at a slow speed (1 m/s). Register the maximum force.
   c. Repeat the above step until you have at least 10 recorded pull force values. Calculate the average pull force value.
3. Measure the pull force downstream the second unit,
   a. Arrange the web material in the dispenser, along the web path so as to extend through the first unit and the second unit.
   b. Measure downstream the second unit by attaching the force gauge clamp to the web material, zero the instrument and pull straight down at a slow speed (1 m/s) until a perforation line breaks. Register the maximum force. Note any tabbing and tearing. Note any failures to break the perforation (double dispensing).
   c. Repeat the above step until you have at least 10 recorded pull force values. Calculate the average pull force value.

FIG. 5 illustrates schematically a cross section through a stack 8 of web material according to embodiments. The stack 8 is adapted for being placed in a stack position 10 of a dispenser 2 according to any one of FIGS. 1 to 3. A tail 21 of web material from the stack 8 is threaded along a web path of a relevant dispenser 2. The web material in the stack 8 of web material is a continuous web material which is Z-folded in an accordion-like manner. The web material comprises a first web 50 divided into sheet products defined between subsequent perforation lines 52, extending across the first web 50. The web material further comprises at least one second web 54 divided into individual products defined between subsequent perforation lines 56 extending across the second web 54. The first and second webs 50, 54 are interfolded so that the perforation lines 52 of the first web 50 are offset from the perforation lines 56 of the second web 56 in a longitudinal direction of the first web 50.

The web material may comprise a plurality of individual web sections interconnected by connecting members 58. Thereby, separate stacks 8 of web material may be interconnected to form one large stack. To this end, at one end or at both ends of the stack 8, the stack 8 may be provided with connecting members 58 for interconnecting the web material of one stack 8 with that of a further stack 8. The connecting members may comprise an adhesion arrangement, or preferably, mechanical arrangements such as hook- and loop interconnections. Thus, replenishing a dispenser 2 with stacks 8 of web material may be facilitated. These connecting members 58 provide the intermittent thickness variations to the web material discussed above.

Advantageously, the perforation lines are formed by alternating bonds and slots. It has been found that a remaining bonded length being the total bond length/(total bond length+total slot length) is between 4% and 50%, preferably between 4% and 25%, most preferred between 4% and 15%, is suitable for the most relevant applications of the stack.

The total bond length/(the total bond length+total slot length) may be used as an indication of the strength of the perforation line. It is desired to provide perforation lines which are strong enough to enable feeding of the web material from the stack in a suitable dispenser, but which are also weak enough to enable separation of the sheets. In this context, it is known that other parameters will also influence the strength of the perforation line, such as the paper quality, and the size, shape and distribution of the slots and tabs. The above-mentioned measure may therefore be useful for guiding the person skilled in the art when selecting suitable perforation lines.

However, for determining the "perforation strength" of the perforation lines, the remaining bonded length measure is inadequate, and instead the method to measure the perforation strength as described in the above should be used.

Example embodiments described above may be combined as understood by a person skilled in the art. It is also understood by those skilled in the art that the dispenser proposed herein comprising resilient units may be used with a stack of non-perforated web material, in which case a separation unit comprising a cutting element may be provided in the dispenser. The cutting element may for instance be a cutting knife, a rotating cutting cylinder, or a serrated edge.

Although the invention has been described with reference to example embodiments, many different alterations, modifications and the like will become apparent for those skilled in the art. For instance, each one of the first and second layers of the web material may comprise one or more sub-layers. The sub-layers may be at least partially connected to each other. The web material in a stack of continuous web material may be V-folded or W-folded in an accordion-like manner.

Therefore, it is to be understood that the foregoing is illustrative of various example embodiments and that the invention is defined only the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A dispenser for dispensing at least one web material, said web material comprising perforation lines dividing said web material into individual products, from a storage of the web material, the dispenser comprising:

a housing arranged to hold the storage of said web material, wherein a web path extends along a feeding direction in an interior of the housing from a storage position to a dispensing opening of the dispenser, and a separation arrangement being arranged along said web path, for separating said at least one web material along said perforation lines, said separation arrangement comprising a first unit and a second unit, said second unit being arranged downstream said first unit, as seen in the feeding direction of said web path, wherein said first unit is arranged to provide a tensioning force on said web material, said tensioning force being at least 2 N/m, and said second unit being arranged to stretch said web material along a length of said web material and along a width of said web material such that the web material is separated along perforation lines at the second unit.

2. A dispenser according to claim 1, wherein said second unit provides a passage through which said web material is to pass for stretching said web material.

3. A dispenser according to claim 2, wherein said passage defines a minimum open gap.

4. A dispenser according to claim 3, wherein said second unit is adjustable for adjusting the size of said minimum open gap.

5. A dispenser according to claim 2, wherein said passage is non-linear for stretching said web material.

6. A dispenser according to claim 5, wherein said non-linear passage comprises at least two curved portions.

7. A dispenser according to claim 5, wherein said non-linear passage is undulated.

8. A dispenser according to claim 1, wherein said second unit is arranged to be resilient so as to be automatically adaptable to intermittent thickness variations in said web material passing through said second unit.

9. A dispenser according to claim 8, wherein said passage of said second unit is resiliently arranged so as to be automatically adaptable to intermittent thickness variations in said web material passing through said passage.

10. A dispenser according to claim 1, wherein said first unit is arranged to provide an adjustable tensioning force to said web material.

11. A dispenser according to claim 1, wherein said first unit comprises at least a contact element arranged to contact said web material so as to provide said tensioning force.

12. A dispenser in accordance with claim 11, wherein said contact element comprises at least one removably mounted mass component, whereby the mass of said contact element is adjustable to adjust said tensioning force exerted by said first unit on said web material.

13. A dispenser in accordance with claim 11, wherein said contact element is spring biased towards said web material.

14. A dispenser in accordance with claim 1, wherein said first unit comprises at least a support element for supporting said web material, and a contact element, being arranged to contact said web material when resting over said support element so as to provide said tensioning force.

15. A dispenser in accordance with claim 14, wherein said tensioning force provided by said first unit comprises the force of gravity acting on the mass of said contact element.

16. A dispenser in accordance with claim 1, wherein said first unit is arranged to be resilient such that said first unit is automatically adaptable to intermittent thickness variations in said web material.

17. A dispenser in accordance with claim 1, wherein said storage of web material is to be in the form of a stack, having a top and a bottom, and said housing is arranged to support the bottom of the stack, and said web path extends from the top of said stack.

18. A dispenser in accordance with claim 1, wherein the perforation lines extend only perpendicularly across the web material.

19. A dispenser in accordance with claim 1, wherein said second unit comprises two rollers with shapes configured to stretch said web material along a width of said web material.

20. A dispenser in accordance with claim 1, wherein said second unit comprises protrusions configured to stretch said web material along a width of said web material.

21. The dispenser in accordance with claim 1, wherein separation of said web material along said perforation lines occurs at every perforation line.

22. A dispenser for dispensing at least one web material, said web material comprising perforation lines dividing said web material into individual products, from a storage of the web material, the dispenser comprising:

a housing arranged to hold the storage of said web material, wherein a web path extends along a feeding direction in an interior of said housing from a storage position to a dispensing opening of the dispenser, and a separation arrangement being arranged along said web path, for separating said at least one web material along said perforation lines, said separation arrangement comprising a first unit and a second unit, said second unit being arranged downstream said first unit, as seen in said feeding direction of said web path, wherein said first unit is arranged to provide an adjustable tensioning force to said web material, and said second unit is arranged to stretch said web material along a length of said web material and along a width of said web material such that the web material is separated along perforation lines at the second unit.

23. The dispenser according to claim 22, wherein said second unit provides a passage through which said web material is to pass for stretching said web material.

24. The dispenser in accordance with claim 22, wherein said second unit comprises two rollers with shapes configured to stretch said web material along a width of said web material.

25. The dispenser in accordance with claim 22, wherein said second unit comprises protrusions configured to stretch said web material along a width of said web material.

26. The dispenser in accordance with claim 22, wherein separation of said web material along said perforation lines occurs at every perforation line.

* * * * *